United States Patent [19]

Komori et al.

[11] Patent Number: 4,733,826

[45] Date of Patent: Mar. 29, 1988

[54] IMPACT CRUSHING MACHINE

[75] Inventors: Keiji Komori, Yokohama; Yoshinaga Takayama, Tokyo, both of Japan

[73] Assignee: Nara Machinery Co., Ltd., Tokyo, Japan

[21] Appl. No.: 86,198

[22] Filed: Aug. 17, 1987

Related U.S. Application Data

[63] Continuation of Ser. No. 870,034, Jun. 3, 1986, abandoned.

[30] Foreign Application Priority Data

Jun. 5, 1985 [JP] Japan ..... 60-122253

[51] Int. Cl.[4] ..... B02C 13/282

[52] U.S. Cl. ..... 241/52; 241/56; 241/79.1; 241/80; 241/188 R; 241/189 R

[58] Field of Search ..... 241/65, 79.1, 66, 186 R, 241/67, 189 R, 80, 97, 60, 61, 62, 52, 56, 188 R

[56] References Cited

U.S. PATENT DOCUMENTS

| | | | |
|---|---|---|---|
| 2,522,027 | 9/1950 | Evans | 241/80 X |
| 3,848,816 | 11/1974 | Morley | 241/65 X |
| 3,917,175 | 11/1975 | Maeda et al. | 241/80 X |

*Primary Examiner*—Mark Rosenbaum

*Attorney, Agent, or Firm*—Birch, Stewart, Kolasch & Birch

[57] ABSTRACT

An impact crushing machine for finely and effectively pulverizing materials includes impact plates disposed on one side of a rotary plate and classifying blades disposed on the other side of the rotary plate. A fine grain exhaust outlet and a coarse grain exhaust outlet are disposed facing to the classifying blades. The coarse grain outlet is directly coupled with a supply path for the materials to form a circulating path, and a raw material supply pipe is coupled with the supply path.

1 Claim, 7 Drawing Figures

IMPACT CRUSHING MACHINE

This application is a continuation of application Ser. No. 870,034 filed on June 3, 1986, now abandoned.

BACKGROUND OF THE INVENTION

1. Field of the Invention

The present invention relates to an impact crushing machine for finely and effectively pulverizing materials such as small blocks of calcium carbonate, talc, graphite and silicone.

2. Description of Prior Art Technique

Most of the high speed rotary type impact crushing machines represented by the name of a pin mill, a hammer mill and the like have a large crushing ratio (diameter of raw materials/diameter of pulverized materials), an extremely short crushing tie or staying time as compared with a grinder type crushing machine and simple handling operation, and hence, are widely used as continuous type crushing machines.

The pulverized grain grade obtained by the high speed rotary impact crushing machine is generally of the order of several 100μ because of the following reasons (1) to (3), and the distribution thereof is also extremely widely scattered.

(1) Since the crushing mechanism is of a so-called one-passs type having an extremely short stating time and utilizes the volume crushing using instantaneous knock, there are materials given impact and materials not given impact sufficiently. The distribution of the pulverized grain grade is widely scattered and the average diameter of the pulverized grain is large.

(2) There is a case, wherein the machine is provided with a screen (punched porous plate) to regulate the grain grade. However, the basic crushing mechanism is of the one-pass type and utilizes the volume crushing in the same manner as the above item (1), and the minimum diameter of the screen is limited to about 200μ because of problems of manufacturing and use thereof (blocking meshes of the screen). Accordingly, the limitation of the crushable diameter is about 100μ.

(3) The materials are also repeatedly crushed by the impact type crushing machine (multi-crushing). Since the distribution of the crushed grain grade is widely scattered, fine grains serve as cushions for materials having large diameter to be crushed and the diameter of the materials to be crushed is reduced.

Heretofore, a classifier is also used together with the crushing machine. In general, materials tend to cohere with each other and are difficult to be separated from each other as the materials are fine grains. Accordingly, the pulverized grains are difficult to be separated from each other and the diameter of the pulverized grain is of the order of several tens micron. Further, if the classification accuracy is increased to obtain fine grains, a great number of coarse grains cut by the classification are left and stable operation can not be performed effectively.

It is thus difficult for the one-pass and high speed rotary type impact crushing machine in the prior art to obtain finely pulverized materials having a uniform diameter of the order of one micron or sub-micron.

SUMMARY OF THE INVENTION

According to the present invention, there is provided a rotary plate having functions of impact crushing and centrifugal classification, and a self-circulating path which guides an air stream in a crushing room and classified coarse grains moving together with the air stream produced by rotation of the rotary member into a supply side of the materials to be pulverized.

Thus, the drawbacks of the one-pass type crushing operation can be eliminated and the pulverized grains (products) can be separated from the crushing system continuously. Accordingly, the crushing operation can be attained effectively. The diameter of the pulverized grains can be reduced and the pulverized grains having the diameter of one micron or submicron can be stably obtained.

More particularly, the gist of the present invention resides in the impact crushing machine characterized by the provision of impact pieces provided on one side of a rotary plate, classifying blades provided on the other side of the rotary plate, a fine grain exhaust outlet and a coarse grain exhaust outlet both facing the classifying blades, and a circulating path formed to directly couple the coarse grain outlet with a supply path of materials to be crushed, the supply path being coupled with a raw material supply pipe.

In the crushing machine according to the present invention, since the coarse grain outlet is directly coupled with the supply path of the material to be crushed, to form the circulating path and the supply path is coupled with the raw material supply pipe, the machine can be formed compactly and the materials can be repeatedly and continuously subjected to the operation of pulverization, classification and re-pulverization without exhaust of the coarse grains to the outside.

Further, since the drawbacks of the prior art one-pass type crushing operation can be compensated for and the finely pulverized grains (products) can be continuously extracted from the coarse grains by classification, the cushion effect on the coarse grains by the intervention of the fine grains can be prevented and the pelverization can be effectively performed so that finely pulverized grain having the diameter of one micron or sub-micron which are difficult to be obtained in the prior art can be effectively and stablly obtained.

DESCRIPTION OF THE INVENTION

The present invention is now described in detail with reference to the drawings.

Figure 1:
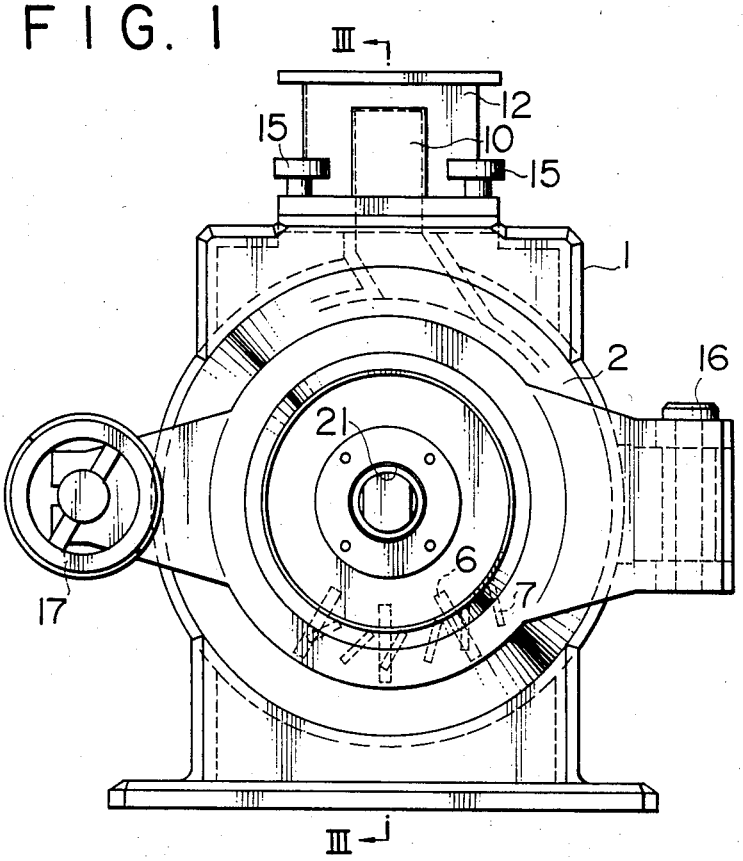
FIG. 1 is a front view of an impact crushing machine of an embodiment according to the present invention.
Figure 2:
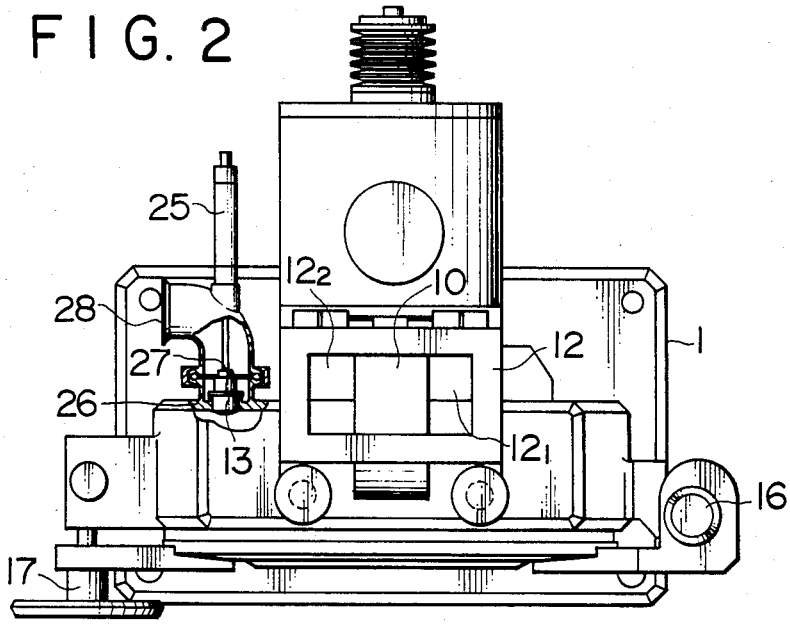
FIG. 2 is a plan view of the machine of FIG. 1.
Figure 3:
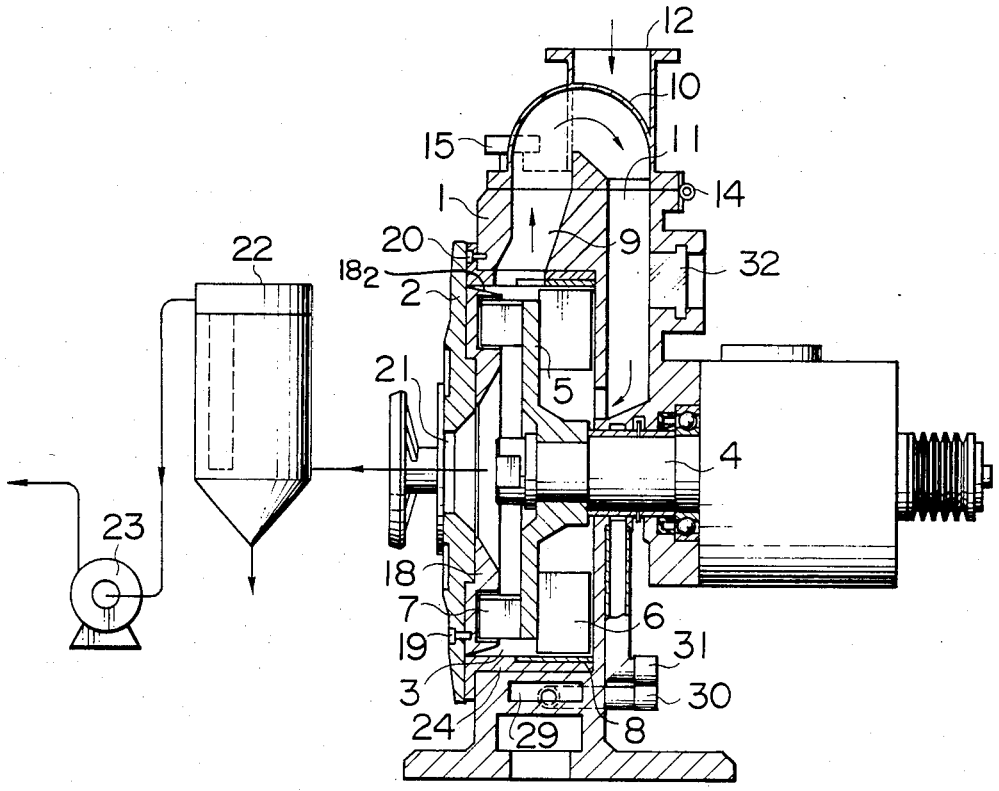
FIG. 3 is a sectional view taken along line III—III of FIG. 1.
Figure 4:
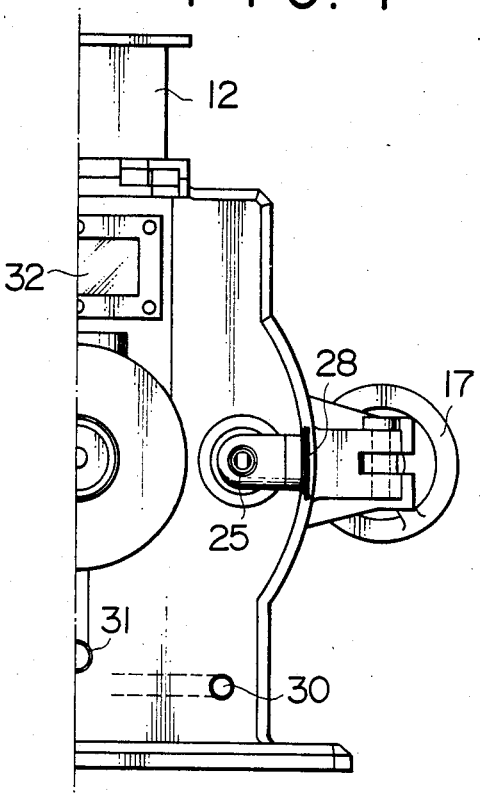
FIG. 4 is a back view of the right half of the machine of FIG. 1.

In FIGS. 1 to 3, numeral 1 denotes a body casing of an impact crushing machine and numeral 2 denotes a cover. The casing 1 and the cover 2 form a crushing chamber and classifying chamber 3 (hereinafter referred to as a crushing and classifying chamber). Within the chamber 3 is disposed a rotary plate 5 which can rotate at a high speed by a rotary shaft 4. Impact plates or pieces 6 necessary to crush materials are attached on one side of the rotary plate 5 radially around the rotary shaft 4. On the other side of the rotary plate 5 are mounted classifying blades 7 for forming centrifugal area necessary for classification.

The disposition of the impact plates 6 and the classifying blades 7 is shown by broken line in FIG. 1. Thus, the impact crushing operation can be performed on one side of the rotary plate and the centrifugal area for classifying pulverized grains can be formed on the other side of the rotary plate by means of high speed rotation of one rotary plate 5.

Numeral 8 denotes a collision ring disposed along a local circular plane formed by the rotation of the outermost end of the impact plates 6 while maintaining small gap between the outermost end and the ring 8. The ring 8 is mounted on an internal periphery of an annular member 24 which is mounted to the casing by screws 20. The annular member 24 can be removed by taking away the screws 20.

A coarse grain exhaust outlet 9 is disposed in the upper portion of the casing 1 through the collision ring 8 and the annular member 24. The coarse grain outlet 9 is coupled with a raw material supply path 11 through a pipe 10 as shown in FIG. 3 to form a self-circulating path. Numeral 12 denotes a raw material supply pipe coupled with the raw material supply path 11 and numeral 13 denotes an alien substance removal valve provided in the crushing and classifying chamber 3.

The pipe 10 and the raw material supply pipe 12 are integrally formed and mounted to the casing 1 by a hinge 14 which allows movement between an open and a closed position. When closed, they are fixed to the casing 1 by bolts 15.

The cover 2 can be easily opened and closed around a hinge 16 mounted to the body casing and can be fixedly and closely secured on the body casing by a clamp 17. A classification adjusting ring 18 is disposed outside of the classifying blades 7 with small gap between the blades 7 and the ring 18 and is exchangeably mounted to the cover 2 by screws 19. The ring 18 forms classification adjusting means by exchanging the ring 18 with another ring having different thickness. The adjusting ring 18 is replaced to vary an amount of overlapping the classifying blades 7 so that suction wind speed at an end of the classifying blades 7 can be changed to vary a diameter of classified grains. Numeral 21 denotes an exhaust outlet for finely pulverized grains, that is, products, and a bag filter 22 for collecting the pulverized grains and a suction blower 23 are coupled with the outlet 21 as additional equipments.

The collision ring 8 is of a conventional type having an uneven portion on its internal surface, and the alien substance removal valve 13 comprises a cylinder 25, a valve seat 26, a valve 27 and an exhaust pipe 28. In the figures, numeral 29 denotes a jacket, which can supply cooling water from an inlet nozzle 30 toward an outlet nozzle (not shown). Numeral 31 denotes a supply pipe of air for purge and numeral 32 denotes a viewing window.

Operation of the crushing machine according to the present invention is performed as follows.

The rotary plate 5 is first rotated at high speed, for example at outer peripheral speed of 80 to 150 m/s and the suction blower 23 is operated to suck air from the crushing machine at air quantity corresponding to a target diameter of classified grains. Then, materials to be crushed, for example small blocks such as calcium carbonate, talc, graphite and silicone are supplied from the supply pipe 12 into the machine. The supplied materials pass through opening $12_1$ and $12_2$ disposed at both sides of the pipe 10 into the raw material supply path 11 and are supplied in the crushing and classifying chamber 3 from the lower end of the supply path 11. The materials are crushed and pulverized in the chamber by operation of the impact plates 6 and the collision ring 8. The pulverized materials are classified and the finely pulverized materials are supplied to the bag filter 22 from the exhaust outlet 21, which are taken out as products. On the other hand, coarse grains which are not finely pulverized pass through the coarse grain exhaust outlet 9 and the pipe 10 into the supply path 11 and are supplied in the crushing and classifying chamber 3 again.

At this time, the rotation of the rotary plate 5 forms a centrifugal area, at the outer periphery of the classifying blades 7 so that the pulverized grains receive centrifugal force f directed outside of the classifying blades 7 and at the same time receive centripetal force R produced by the classifying blades 7 having a width W and directed toward the exhaust outlet 21 at suction speed. Accordingly, the classified diameter of the pulverized grains is defined by the diameter of the grains classified when $f=R$. If $f>R$, the grains are sprung out from the circulating inlet 9 and supplied to the self-circulating line 9–11 for circulation so that the grains are re-crushed. If $f<R$, the grains are sucked inside as products and collected through the exhaust outlet 21 into the bag filter 22.

The crushing machine according to the present inventin has the suction speed formed by the classifying blades having the width W which is related to the classification diameter of the grains, and by exchanging the classification adjusting ring 18 with another ring having a different thickness, an amount of overlapping of the classification adjusting ring 18 to the classifying blades 7 can be adjusted so that the suction speed can be varied and the classified diameter of the grains can be adjusted. As an alernative to the exchange of the ring, an annular ring may be moved by using a screw from the outside to adjust the overlapping amount.

As described above, the materials supplied from the supply inlet 12 are joined with the coarse grains returned through the circulating path and supplied through the supply inlet into the crushing chamber. Then, the joined grains receive the centrifugal force by the high speed rotation of the rotary plate 5 to be moved outside or inside of the machine. Thus, the materials receive impact by the impact plates 6 mounted to the rotary plate 5 and further receive impact crushing operation by the collision ring 8 mounted on the outer periphery. The crushed grains are then classified immediately. While the classification is performed on the basis of the classification principle descrived above, since the classification is performed immediately after crushed, the crushed grains are well scattered and there is no time that the grains are cohered with each other, thereby improving the accuracy of the classification extremely.

As described above, the fine grains are sent out as products and the coarse grains are re-crushed through the self-circulating path. However, if the materials are natural substances, there is a case where the materials contain a small amount of alien substances (coarse grains) which are difficult to be made small even if repeatedly crushed. If he alien substances are left as they are, the alien substances occupy the inside of the crushing machine, resulting in reduction of the crushing efficiency and overload.

In the present invention, there is provided the valve 13 for removing the alien substances (coarse grains) in the self-circulating line and the cylinder 25 is operated if necessary so that the valve body 27 is opened and closed with regard to the valve seat 26 intermittently and the circulating substances are excluded outside of the machine by internal pressure of the self-circulating line immediately. The operation of the crushing machine is further stabilized by the opening and closing operation of the valve 13.

In the crushing method of this type, since air in the machine is rotated at high speed and circulated, there is a case that the temperature in the machine is increased to a high temperature which is bad for the materials in the machine. However, in the crushing machine of the present invention, cooling water is supplied into a space 29 enclosed by the casing 1 and the collision ring 8 by using the nozzle 30 and the materials can be cooled.

Figure 5:
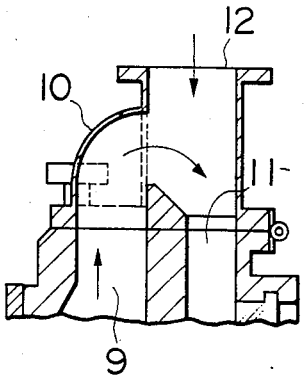
FIG. 5 is a sectional view of a portion of another embodiment according to the present invention.

Various modification and addition can be made to the present invention within the scope of the above gist. For example, as shown in FIG. 5, the pipe 10 may be directly coupled with the side of the supply pipe 12 and the same operation and effects are attained. Further, the classifying blades 7 may be disposed radially in the same manner as the impact plates 6.

Figure 6:
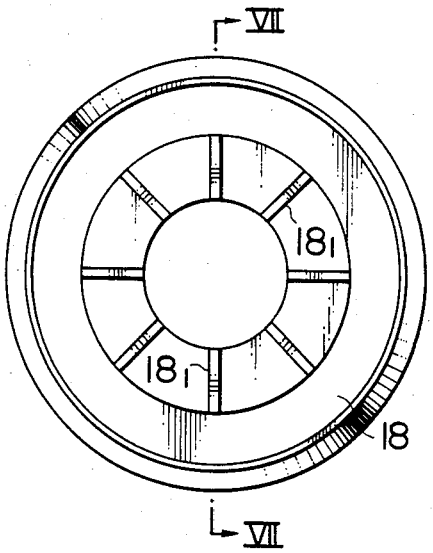
FIG. 6 is a plan view of another embodiment of an adjustment ring.
Figure 7:
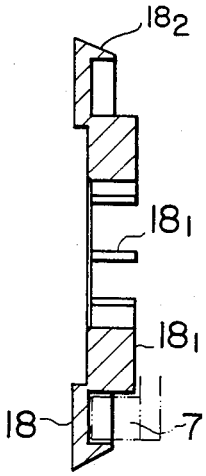
FIG. 7 is a sectional view taken along line VII—VII of FIG. 6.

Further, as shown in FIGS. 6 and 7, there can be disposed radial blades $18_1$ inside of the adjustment ring 18, thereby preventing occurrence of a forcible eddy produced by the rotary plate 5 and the classifying blades 7 and capable of increasing the classification efficiency sufficiently by the suction blower of relatively small horsepower. Also provided on the adjustment ring 18 is a flange $18_2$ which can be of an appropriate length for a particular operation.

We claim:

1. An impact crusher comprising a cylindrical casing, a rotatable plate having first and second sides and an axis mounted in said cylindrical casing, means for rotating said plate at high speed about said axis, impact pieces disposed on said first side of said plate in a radial direction, classifying blades disposed on said second side of said plate, a first pipe passage for the supply of material to be crushed connected to said casing and terminating facing an inward zone relative to said radial direction of said impact pieces, a discharge outlet of fine powder being formed in said casing, said discharge outlet being connected to a suction blower through a filter, said casing having an inner-circumferential surface having a size relationship with said rotatable plate to provide an external clearance to said rotatable plate, which provides means to conduct the crushed material discharged from the external circumference of said impact pieces to the external circumference of said classifying blades while guiding the crushed material by the inner-circumferential surface of said casing, a discharge outlet of coarse powder is formed in a portion of said casing facing the external circumference of said classifying blades, said discharge outlet of coarse powder being connected to said first pipe passage for the supply of material by means of a second pipe passage, and a classifying adjustment ring, having a circular groove engaged by a portion of said classifying blades with a small clearance therebetween, is disposed adjacent said classifying blades, the area of air passage between said classifying blades being adjusted by means of said classifying adjustment ring, thereby enabling the flow speed of air to be adjusted.

* * * * *